United States Patent [19]

Suzuki et al.

[11] 4,367,382

[45] Jan. 4, 1983

[54] VACUUM CIRCUIT BREAKER

[75] Inventors: Hideo Suzuki, Yokohama; Nobuo Kawashima, Tokyo; Satoru Yanabu, Machida; Eiichi Takayanagi, Yokosuka, all of Japan

[73] Assignee: Tokyo Shibaura Denki Kabushiki Kaisha, Kanagawa, Japan

[21] Appl. No.: 41,929

[22] Filed: May 24, 1979

[51] Int. Cl.[3] ..... H01H 33/66

[52] U.S. Cl. ..... 200/144 B

[58] Field of Search ..... 200/144 B

[56] References Cited

U.S. PATENT DOCUMENTS 3,683,138 8/1972 Nabae et al. ..... 200/144 B 3,946,179 3/1976 Murano et al. ..... 200/144 B

OTHER PUBLICATIONS

IEEE Trans. Power Apparatus and System, pp. 1723–1732, High Current Vacuum Arcs Stabilized by Axial Magnetic Fields By. Morimiya.

*Primary Examiner*—Robert S. Macon

*Attorney, Agent, or Firm*—Stevens, Davis, Miller & Mosher

[57] ABSTRACT

In a vacuum circuit breaker of the type comprising coil electrodes for producing longitudinal magnetic flux and contacts made of an Ag-WC sintered alloy, the intensity of the magnetic field is made to be higher than 50 gausses/$I_B$.

5 Claims, 7 Drawing Figures

VACUUM CIRCUIT BREAKER

BACKGROUND OF THE INVENTION

This invention relates to a vacuum circuit breaker, more particularly a longitudinal or axial field type vacuum switch utilizing contacts made of an Ag-WC alloy.

A vacuum circuit breaker generally comprises a vacuum vessel made up of an insulating casing and end plates closing the opposite ends thereof, and a pair of separable electrodes disposed in the vacuum vessel. The electrode utilized in the conventional vacuum circuit breaker comprises a central contact 1 and a spiral electrode 2 surrounding the contact 1 and provided with a plurality of spiral grooves $2_a$, as shown in FIG. 1. With this construction, an electric arc struck at the time of circuit interruption is driven by rotating magnetic flux thus improving the ability of interrupting large currents. More particularly, the arc is rotated around the electrode 2 for avoiding local heating thereof thus enabling satisfactory interruption of large currents.

To enable interruption of large currents, it is necessary to transfer the arc struck at the contact 1 to the electrode 2. To this end, it is necessary to use materials having a small arc voltage difference for the contact 1 and the electrode 2. Since material having high electroconductivity has excellent interruption performance, copper has generally been used for electrode 2. On the other hand, alloys containing copper as the major ingredient has been used for the contact 1, and bismuth has been added to the copper alloy for the purpose of preventing fusion of the conacts which occurs when large short circuiting current flows therethrough.

The Cu-Bi contact material accompanies such problem that the bismuth evaporates selectively when it is subjected to high temprature arc thereby increasing the current chopping level during the use of the vacuum circuit breaker, which results in the creation of switching surges. Among copper rich contact alloys are also included Cu-Al alloys and similar alloys. These prior art copper alloys have been developed for the purpose of improving interrupting performance, anti-fusing characteristic and voltage resistant characteristic but are not always satisfactory for preventing switching surge.

Ag-WC type contact materials have been used as low surge contact materials. Since these materials have excellent low surge characteristic, they have been used abundantly for vacuum switches not requiring large interrupting capacity, but these materials involve many problems to be solved for use in vacuum switches for interrupting large currents.

Vacuum circuit breakers are generally used in electric power systems having low surge impedances, in which the chopping level does not present any serious problem so that above described copper rich contact materials could be used. However, in recent years, the electric power systems are becoming complicated and since a chance of interrupting inductive loads such as large capacity induction motors with vacuum switches is increasing it is necessary to solve the problem of switching surge depending upon the type of loads. In such case, injurious surges have been alleviated by connecting surge absorbers in circuit with the vacuum circuit interrupters.

As is well known in the art, the current interruption phenomenon of a vacuum circuit breaker utilizes diffusion in vacuum of metal vapor generated in a large quantity by arc struck at the time of current interruption. Concurrently with its generation, the metal vapor diffuses in a surrounding vacuum space to deposit and condense on an arc shield or low temperature portions of the electrodes whereas the vapor pressure at the arc is high. At a current zero, the energy supplied to the arc decreases to zero and the interrupting performance of the vacuum circuit breaker is greatly governed by the metal vapor remaining at the time of current zero. After the current zero the remaining metal vapor diffuses at a high speed to decrease the vapor pressure. However, during this interval, since recovering voltage is applied across the electrodes, satisfactory current interruption cannot be realized unless the mean free path of the metal vapor exceeds the length of the electrode gap and the vapor pressure is decreased sufficiently to withstand the rise in the recovering voltage.

The variation in the density of the metal vapor after current zero is expressed by the following equations:

$$n = n_o\left[1 - \exp\left(-\frac{1}{\alpha^2}\right)\right] erf\left[\frac{1}{2}\left(\frac{L}{R}\right)\frac{1}{\alpha}\right] \quad (1)$$

$$d = \frac{t}{R}\left(\frac{2KT}{M}\right)^{\frac{1}{2}} \quad (2)$$

where:

$n_o$: initial density of the metal vapor at a current zero;
erf: error function;
R: radius of electrode;
M: mass of a metal atom;
K: Boltzman constant;
T: temperature of metal atoms;
L: gap length between electrodes.

The initial value $n_o$ is given by the following equation:

$$n_o = \frac{\omega}{\beta} \cdot \frac{\sqrt{2} \cdot I_{rms} \cdot E}{M\pi R^2 L} \quad (3)$$

$$\beta = \left(\frac{L+R}{2RL}\right) \times \left(\frac{8KT}{\pi M}\right)^{\frac{1}{2}} \quad (4)$$

where $\omega$: $2\pi f$, f: frequency
$I_{rms}$: effective value of the current interrupted
E: evaporation coefficient As can be noted from these theoretical equations, the interruption performance of a vacuum circuit breaker depends upon not only the geometrical construction of the electrodes but also the characteristics of the electrode material.

We have found that the general theory described above cannot be supplied to the Ag-WC contact material utilized in this invention. More particularly, the Ag-WC contact material is a sintered alloy which is prepared by press molding a power of WC, sintering the press molded back and then impregnating Ag so that the interrupting performance is largely governed by Ag having lower melting point than WC. Accordingly, it is impossible to consider the Ag-WC alloy as the source of metal vapor remaining after current zero. For this reason, stable arc voltage of Ag-WC contacts is about 20 to 30 volts which is lower than the arc voltage of 40 to 80 volts of copper rich contact materials, for example Cu-Bi alloys and the stable range of the arc is narrow.

As a result of investigation concerning arc of Ag-WC contacts, we have found that in a current interruption limit range a large number of red heat metal particles fly about the arc. It is considered that this phenomenon is caused by the fact that the arc consists essentially of ionized vapor of Ag whereas sputtering of red heat metal particles is caused by the destruction of the bonding of the particles of WC. For this reason, the limit of the interruption performance cannot be determined by the prior art theory in which only the amount of remaining metal vapor and diffusion thereof have been taken into consideration. Rather, the limit should be based on the destruction of the bond between WC particles. For this reason, as shown in FIG. 2, the interrupting performance of Ag-WC type contact is much inferior than that of copper or copper rich alloy thus resulting in a difference in the interrupting mechanism.

On the other hand Ag-WC type contact materials have excellent low surge characteristic so that these materials have been exclusively used for vacuum circuit interrupters having a rating of less than 8 kA, not requiring high interrupting performance.

In recent years, electric power systems become complicated and their capacities become large so that vacuum circuit breakers connected in series with such inductive load as motors are required to have a low surge characteristic.

Since a vacuum circuit interrupter is required to have a large interrupting capacity, as above described a copper electrode with spiral grooves has been used, and at the center of the electrode is mounted a contact made of copper incorporated with a small quantity of Bi or the like which is a welding preventing material. As is well known in the art, the principle of circuit interruption of such spiral electrode is to transfer electric arc struck between separated contacts to the spiral electrode by magnetic force thus causing the arc to rotate by rotating magnetic force created by the spiral grooves. Consequently, local heating of the electrode is prevented and metal vapor remaining at the time of current zero is decreased thereby improving the interruption performance. In order to improve the interruption performance with this electrode construction it is absolutely necessary to transfer the arc onto the electrode. To this end, it is necessary to construct the contact and the electrode with materials having substantially the same arc voltage. Thus contact materials of Cu-Bi type or Cu-Te type are suitable for spiral electrodes in view of their arc voltages. On the other hand, Ag-WC type contact material cannot improve the interruption performance because its arc voltage is lower than that of Cu as above pointed out and is extremely difficult to transfer arc struck between contacts to the electrode.

Accordingly, Ag-WC type contact material cannot be used in vacuum circuit breakers of large interrupting capacity because its interruption phenomenon is different from those of the other contact materials and because it cannot be applied to a spiral electrode owing to the difference in arc voltages although Ag-WC type contact material has an excellent low surge characteristic.

We have investigated the degree of improvement of the interruption performance caused by the use of Ag-WC together with so-called longitudinal magnetic field electrode and found that the interruption performance could not be improved as expected as shown by FIG. 3. Because an appropriate intensity of 30 gausses/$I_B$ determined by experiment by taking into consideration the quantity of metal vapor remaining at the time of current zero cannot be applied to contact materials having different interruption phenomena, where $I_B$ represents the crest value in kA of a rated current to be interrupted.

We have also made various experiments on the longitudinal magnetic field electrode to know that for what reason can Ag-WC type contact material having excellent low surge characteristic interrupt large current. The result is shown in FIG. 4 from which it can be noted that when the intensity of the magnetic field is increased above 50 gausses/$I_B$, the current interruption performance can be improved greatly. The result of experiment revealed that this was caused by the fact that the limit of destroying the bonds between WC particles was improved by increasing the intensity of the magnetic field.

As above described, we have found an optimum field condition for a case where Ag-WC contact material is combined with a longitudinal magnetic field electrode, and succeeded to provide a vacuum circuit breaker of large interruption capacity and excellent low surge characteristic.

Chopping phenomenon means a phenomenon in which current is abruptly interrupted before a current zero point caused by instability of small current arc. As expressed by the following equation (5), surge voltage caused by this phenomenon is a product of chopping current $I_c$ and a surge impedance $Z_s$ and damages insulation of electric machines and apparatus:

$$V = I_c \cdot Z_s = I_c \cdot \sqrt{\frac{L}{C}} \tag{5}$$

where L represents line inductance and C line capacitance which are the surge constants of an external circuit. Accordingly, in order to decrease the surge voltage it is necessary to lower the chopping level. Although the theory of the chopping phenomenon is not yet established well, it has been proposed to use such material having high vapor pressure as Bi and Sb as contact material as a method of decreasing unstable region of small current arc for causing small current arc to persist thus lowering the chopping level. Cu-Bi type contact material is based on this concept and has been used to some extent but as the melting point of Bi is lower than that of Cu and the vapor pressure is higher, Bi is readily vaporized by the arc thus manifesting a tendency of selective evaporation. For this reason, when current interruption is repeated many times the quantity of Bi in the contact becomes deficient thus increasing the chopping current.

The mechanism of chopping phenomenon is different for Ag-WC contact materials, that is inspite of the use of Ag having much lower vapor pressure than Bi, the chopping current of this material is low. It is considered that the thermionic radiation of WC contributes to the stabilization of small current arc. The chopping level of the Ag-WC material does not increase but remains at a stable low level even after many times of interruption.

SUMMARY OF THE INVENTION

Accordingly it is an object of this invention to provide an improved vacuum circuit breaker which does not require an external surge absorber, and has a low surge characteristic and an excellent large current interrupting performance.

According to this invention there is provided a vacuum circuit interrupter comprising a pair of relatively movable electrodes, at least one of the electrodes being a coil electrode for producing longitudinal magnetic field in parallel with electric arc struck between the electrodes, and contacts mounted on the electrodes and made of an Ag-WC sintered alloy, wherein the intensity of the magnetic field is made to be higher than 50 gausses/$I_B$, where $I_B$ represents the crest value of a rated interrupting current of the vacuum circuit breaker.

DESCRIPTION OF THE PREFERRED EMBODIMENT

Figure 1:
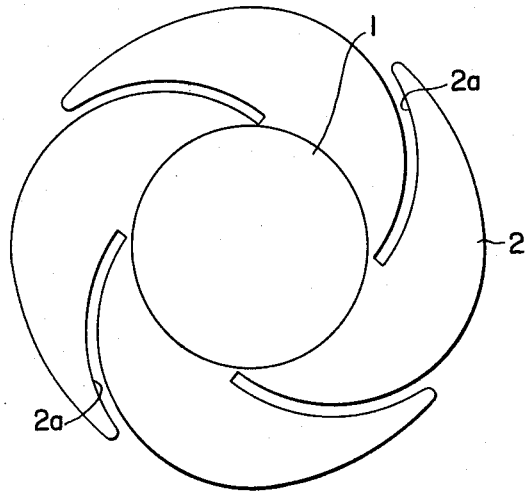
FIG. 1 PRIOR ART
FIG. 1 is a plan view showing a prior art spiral electrode.
Figure 2:
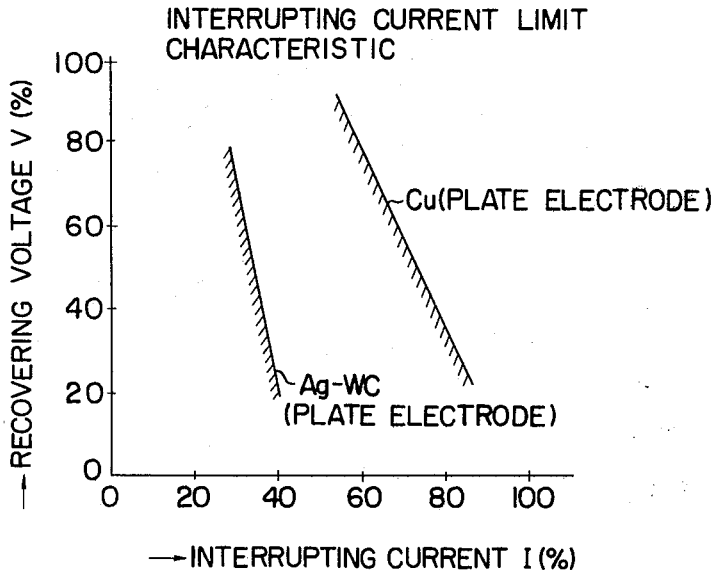
FIG. 2 is a graph showing the interrupting current limit characteristics of Cu and Ag-WC electrodes.
Figure 3:
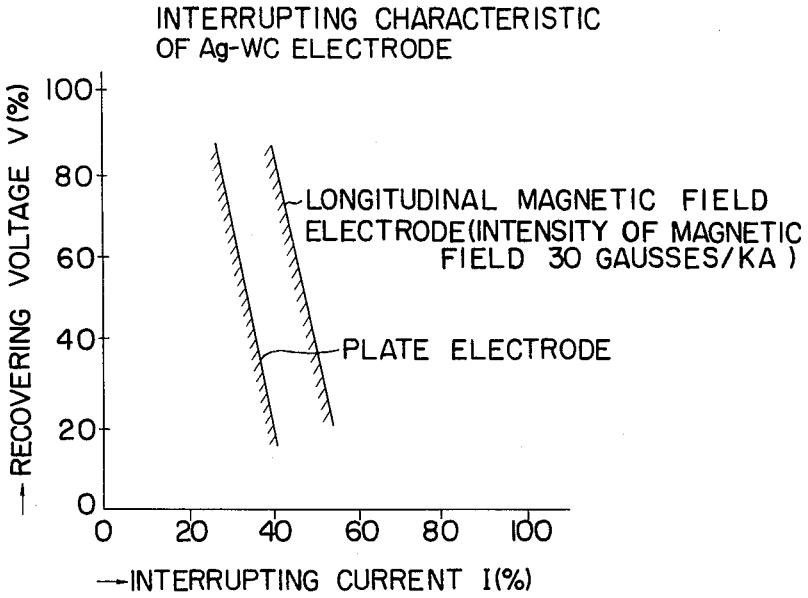
FIG. 3 is a graph showing the interrupting characteristic of Ag-WC electrodes.
Figure 4:
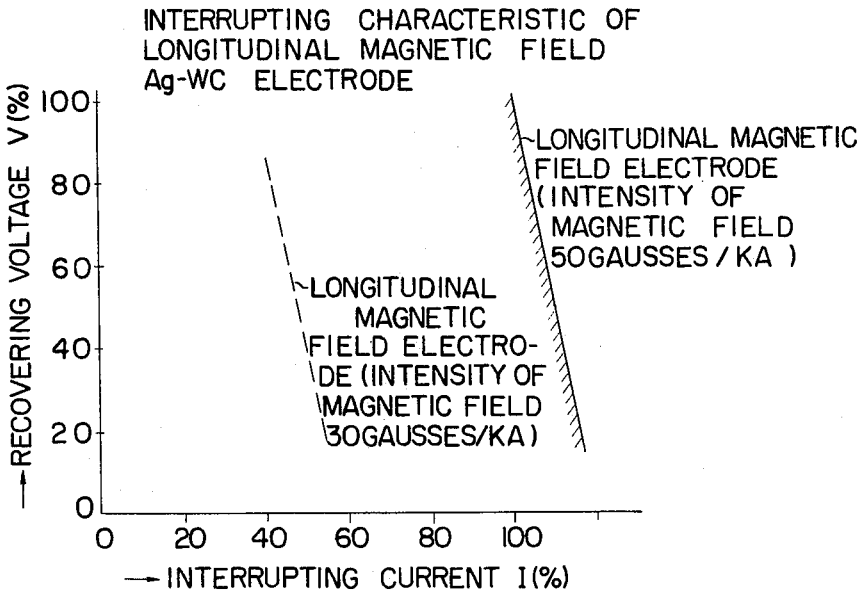
FIG. 4 is a graph showing the interrupting characteristic of a longitudinal magnetic field Ag-WC electrode.
Figure 5:
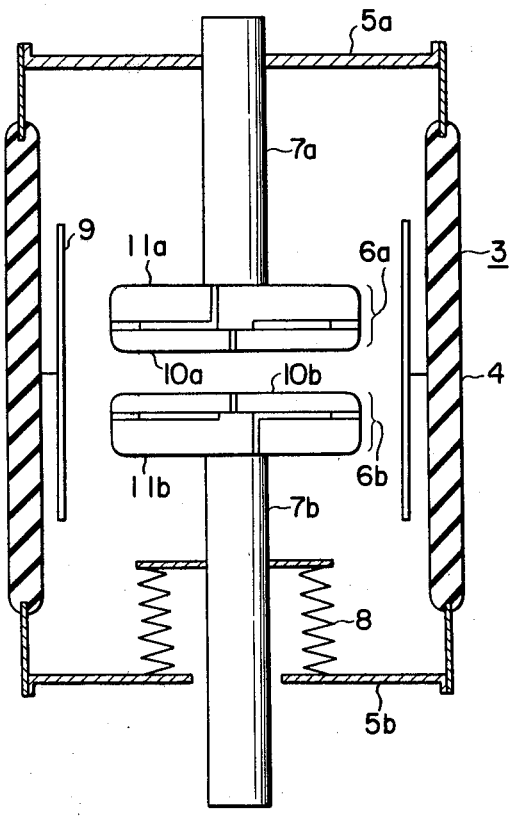
FIG. 5 is a longitudinal sectional view showing one embodiment of this invention.
Figure 6:
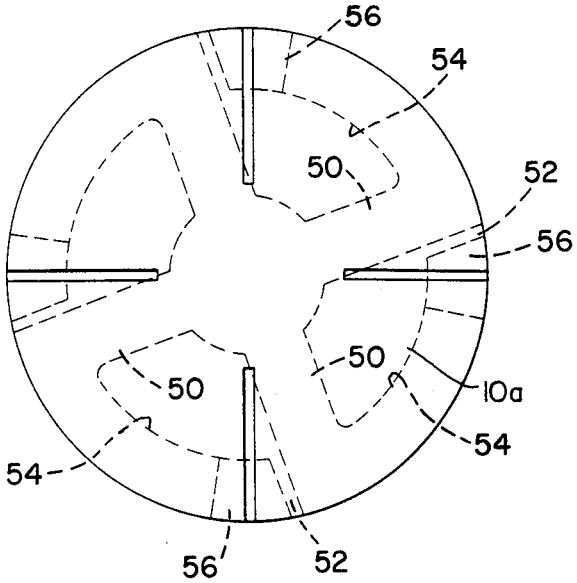
FIGS. 6 and 7 are a plan view and a sectional view respectively of the electrode utilized in the embodiment shown in FIG. 5.
Figure 7:
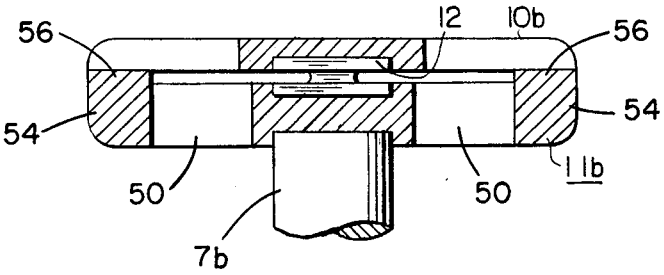

A preferred embodiment of this invention illustrated in FIGS. 5, 6 and 7 comprises an evacuated vessel 3 made up of an insulating cylinder 4, preferably made of transparent material, end plates $5_a$ and $5_b$ are tightly sealed to the opposite ends of the cylinder 4, and a pair of separable electrodes $6_a$ and $6_b$. One electrode $6_a$ is supported by a stationary rod $7_a$ extending through the end plate $5_a$, while the other electrode $6_b$ is connected to a movable rod $7_b$ which extends through the end plate $5_b$ through a bellows 8. An arc shield 9 is provided to surround electrodes $6_a$ and $6_b$ to prevent metal vapor generated by the electrodes $6_a$ and $6_b$ at the time of separation thereof from depositing on the inner surface of the evacuated vessel. Electrodes $6_a$ and $6_b$ have so-called longitudinal magnetic field electrode construction in which contacts $10_a$ and $10_b$ made of an Ag-WC sintered allow and coil electrodes $11_a$ and $11_b$ on the back thereof are combined so as to create magnetic field in a direction parallel with the arc.

As disclosed in U.S. Pat. No. 3,946,179 dated Mar. 23, 1976, each coil electrode comprises four radially extending arms 50 with a stationary or movable rod *7a* or *7b* connected to the cross-point of the arms. Four arcuate sections 54 are each connected to the outer end of the arms with gaps 52 between adjacent arms. Each arcuate section is provided with a projection 56 near its free end or adjacent to the gap 52 to engage the back surface of the contacts 10*a* or 10*b*. The coil electrodes are made of an electroconductive material such as copper. When contacts 10*a* and 10*b* are separated, current flows through stationary rod 72, arms 50, arcuate sections 54, projections 56, stationary contact 10*a*, movable contact 10*b*, the coil electrode 11*b* to the movable rod *7b*. Thus, the current is divided into four components each flowing through one of the arms 50 and one of the arcuate sections 54 connected thereto thus forming a strong magnetic field in the direction of movement of the movable rod *7b*. The magnetic field thus formed confines the arc and prevents escape of ionized metal vapor or plasma from the arc. Consequently the arc is stabilized and uniformly distributed over the surfaces of the contacts 10*a* and 10*b* thus improving the interrupting capacity. Contacts $10_a$ and 10*b* are supported by reinforcing plates 12 made of Ni or stainless steel having high electrical resistance so that they do not affect the intensity of the magnetic field generated and prevent deformation or rupture of the contacts $10_a$ and $10_b$ caused by mechanical shocks at the time of closing of the circuit breaker.

With this construction, as the magnetic field is created in parallel with the arc it is possible to decrease the arc voltage. Moreover, as the arc is spread uniformly on the contacts $10_a$ and $10_b$ it is not only possible to prevent local heating thereof but also to decrease the surface current density thereby enabling interruption of large current. Moreover, since Ag-WC sintered alloy is used for the contacts $10_a$ and $10_b$, low surge characteristic can be obtained. Accordingly, it is possible to obtain a vacuum circuit breaker capable of interrupting large current with a low surge that cannot be realized with a conventional spiral electrode. Table 1 below compares the interruption performances for different contact materials and different electrode constructions but having the same electrode diameter. In Table 1, the interrupting current limit of sample 1 was taken 100%, and the recovering voltage at the time of interruption test was set to be less than 7.2 kV. The data in brackets show percentage of W, and Bal means a small quantity of additives.

TABLE 1

| Sample No. | Contact material | Electrode material | Electrode construction | Interruption performance |
|---|---|---|---|---|
| 1 | Te(4)—Cu—Bal | Cu | spiral | 100% |
| 2 | Ag(30)—WC—Bal | Cu | spiral | 50% |
| 3 | Ag(30)—WC—Bal | — | longitudinal magnetic flux | 120% |

Suppose now that a pair of serially connected coils each having a radius of a and spaced 2× is used. Then, the flux density B′ generated by one coil and measured at the mid point between the two coils is expressed by:

$$B' = \mu_o H$$

$$= 4\pi \times 10^{-7} \frac{a^2 \cdot I}{2(a^2 + x^2)^{3/2}} \ (W_b/m^3) \quad (6)$$

$$= 2\pi \times 10^{-3} \frac{a^2 \cdot I}{(a^2 + x^2)^{3/2}} \ \text{(gauss)} \quad (7)$$

where $\mu_o$ represents permeability, H the intensity of magnetic flux, I current in ampere. Since the magnetic field produced by the other coil is also present at the mid point, the resultant magnetic flux density B at that point is expressed by:

$$B = 2B' = 4\pi \times 10^{-3} \frac{a^2 \cdot I}{(a^2 + x^2)^{3/2}} \ \text{(gauss)}. \quad (7)$$

Since the magnetic flux density required by this invention should be higher than 50 gausses/$I_B$, where $I_B$ represents the crest value of the rated interrupting current in kA, by introducing this relation into equation (7) we obtain:

$$B/I_B = 4\pi \frac{a^2}{(a^2 + x^2)^{3/2}} \geqq 50. \quad (8)$$

This means that a and x should be selected to satisfy equation 8.

For example, when the coil shown in FIG. 6 is divided into 2 arcuate sections instead of 4, equation (8) becomes:

$$B/I_B = 4\pi \frac{a^2}{(a^2 + x^2)^{3/2}} \times \tfrac{1}{2}.$$

In the same manner, when the coil is divided into 3 sections, equation (8) becomes:

$$B/I_B = 4\pi \frac{a^2}{(a^2 + x^2)^{3/2}} \times \tfrac{1}{3}$$

Generally stated, where the number of division is n, equation (8) becomes:

$$B/I_B = \frac{4\pi}{n} \times \frac{a^2}{(a^2 + x^2)^{3/2}} \geqq 50. \quad (4)$$

For example, in a case where n=4, a=0.045 m, and x=0.008 m:

$$B/I_B = \frac{4\pi}{4} \times \frac{0.045^2}{(0.045^2 + 0.008^2)^{3/2}} = 66.6 \text{ (gausses/kA)}$$

which is considerably larger than 50 gausses. However, actually measured value of $B/I_B$ was 56.6 gausses/kA. It is considered that the difference between the theoretical value 66.6 and the measured value 56.6 was caused by eddy current in the electrodes. For other values of a, x and n, the measured values were smaller than the theoretical values by about 15%.

As described above, it is easy to design the coil electrode to generate magnetic flux higher than 50 gausses-/$I_B$ by suitably selecting parameters a, x and n.

In a combination of a spiral electrode and an Ag-WC contact material having a low surge characteristic, the difference in the arc voltage caused by the difference in the materials causes such problem that arc is difficult to transfer to the electrodes thus failing to improve the interruption performance. In contrast, this problem can be solved by a novel combination of the longitudinal magnetic field electrode and the Ag-WC contact material with a specific flux density described above. More particularly, the invention utilizes the advantage of the longitudinal magnetic flux construction which spreads the arc uniformly over the contacts and the advantage of Ag-WC contact having excellent low surge characteristic so as to interrupt large current.

In sample 3 of Table 1, the balance may include a small quantity of such other elements as Fe, Ni and Co.

Although in the embodiment shown in FIG. 5, arc shield 9 was shown at about the center of the evaculated vessel, the shield may be located closer to the end plate $5_a$ or $5_b$ since the position of the shield does not affect the interruption performance.

As above described the vacuum circuirt interruptor of this invention can be used for any load without using an external surge absorber.

What is claimed is:

1. In a vacuum circuit interrupter comprising a pair of relatively movable electrodes, at least one of the electrodes being a coil electrode for producing a longitudinal magnetic flux in parallel with the electric arc struck between the electrodes, and contacts mounted on the electrodes and made of an Ag-WC sintered alloy, the improvement wherein the intensity of said magnetic field generated by said coil electrode is made to be higher than 50 gausses/$I_B$, where $I_B$ represents the crest value of a rated interrupting circuit of said vacuum circuit breaker.

2. In a vacuum circuit breaker of the type comprising a vacuum vessel, a pair of relatively movable current-carrying rods, and a pair of electrodes having contacts made of an Ag-WC sintered alloy, wherein each electrode is connected to the end of one current-carrying rod, and at least one of the electrodes has a coil electrode on the back thereof, wherein said coil electrode includes a plurality of radial arms, and wherein the end of one current-carrying rod is electrically connected to a cross-point of said arms, and wherein each electrode further includes a plurality of arcuate sections, one end of each arcuate section being electrically connected to the outer end of each arm and the other end being spaced from an adjacent arm, and wherein each of said other ends of said arcuate sections is provided with projections which are electrically connected to at least one of said contacts thereby producing longitudinal magnetic flux in parallel with an electric arc struck between the electrodes, the improvement being that the intensity of said magnetic flux generated by said coil electrode is made to be higher than 50 gausses/$I_B$, wherein $I_B$ represents a crest value of a rated interrupting current of said vacuum breaker.

3. A process for breaking a circuit by means of a vacuum circuit breaker of the type including a pair of relatively movable electrodes, at least one of the electrodes being a coil electrode for producing a longitudinal magnetic flux in parallel with the electric arc struck between the electrodes, and contacts mounted on the electrodes and made of an Ag-WC sintered alloy, comprising the step of:

generated a magnetic flux of at least 50 gausses/$I_B$ during the circuit breaking operation by means of the coil electrode where $I_B$ represents the crest value of a rated interrupting current of said vacuum circuit breaker.

4. A method for interrupting a circuit having a large current utilizing a vacuum circuit breaker with low surge characteristics comprising a pair of relatively movable electrodes, at least one of said electrodes being a coil electrode for producing a longitudinal magnetic field, and means forming contacts associated with each of said electrodes formed substantially of Ag-WC sintered alloy, said method comprising the nearly simultaneous steps of:

separating said electrodes;

producing a longitudinal magnetic field in excess of 50 gausses/$I_B$ where $I_B$ represents a crest value of a rated interrupting current in kA such that the magnetic field is created in parallel with the arc and the arc is spread uniformly on the contact means thereby decreasing surface current density and enabling interruption of large currents;

interrupting the arc sufficiently to withstand the rise in the recovery voltage such that during the interrupting step there occurs the chopping phenonmenon in which the current is abruptly interrupted before current zero causing a surge voltage, which is the product of the chopping current and the surge impedance, said Ag-WC sintered alloy contact means operating to achieve low surge characteristics to facilitate the current interruption.

5. The method of claim 4 wherein the electrodes are situated behind said contact means relative to a central area in which the arc is produced and said contact means are reinforced by plates made of a material having a high electrical resistance to prevent deformation or rupture of said contact means caused by mechanical shocks of the circuit breaker.

* * * * *